US011391552B1

(12) United States Patent
Grassi

(10) Patent No.: US 11,391,552 B1
(45) Date of Patent: Jul. 19, 2022

(54) HIGH-FRAGMENTING FLASHBANG GRENADE CHARGE HOLDER

(71) Applicant: Michael Grassi, Columbus, OH (US)

(72) Inventor: Michael Grassi, Columbus, OH (US)

( * ) Notice: Subject to any disclaimer, the term of this patent is extended or adjusted under 35 U.S.C. 154(b) by 0 days.

(21) Appl. No.: 16/542,293

(22) Filed: Aug. 15, 2019

Related U.S. Application Data

(60) Provisional application No. 62/719,395, filed on Aug. 17, 2018.

(51) Int. Cl.

| | |
|---|---|
| ***F42B 12/42*** | (2006.01) |
| ***F42B 8/26*** | (2006.01) |
| ***F42B 27/00*** | (2006.01) |
| *F42B 12/36* | (2006.01) |
| *F42C 14/02* | (2006.01) |
| *F41A 33/04* | (2006.01) |

(52) U.S. Cl.
CPC ..... *F42B 27/00* (2013.01); *F42B 8/26* (2013.01); *F42B 12/42* (2013.01); *F41A 33/04* (2013.01); *F42B 12/367* (2013.01); *F42C 14/02* (2013.01)

(58) Field of Classification Search
CPC .. F42B 27/00; F42B 12/36; F42B 8/26; F42B 3/087; F42B 3/28; F42B 3/11; F42B 12/42; F42C 19/08; F42C 19/0815; F42C 19/0823; F42C 19/0826
USPC ..... 102/482, 483, 484, 485, 486, 487, 488, 102/331, 282
See application file for complete search history.

(56) References Cited

U.S. PATENT DOCUMENTS

| | | | | | |
|---|---|---|---|---|---|
| 3,505,959 | A * | 4/1970 | Hans | F42C 1/08 | 102/256 |
| 3,645,205 | A * | 2/1972 | Dowling | F42B 3/087 | 102/318 |
| 3,760,729 | A * | 9/1973 | Freeman | F42B 4/02 | 102/346 |
| 3,795,197 | A * | 3/1974 | Levenson | F42B 12/50 | 102/368 |
| 4,010,690 | A * | 3/1977 | Cocozella | F42B 39/18 | 102/282 |
| 4,033,264 | A * | 7/1977 | Bolza | C06B 45/10 | 102/314 |
| 4,036,138 | A * | 7/1977 | Chopra | F42B 3/00 | 102/331 |
| 4,078,496 | A * | 3/1978 | Kruger | F42C 15/285 | 102/255 |
| 4,726,295 | A * | 2/1988 | Embury, Jr | F42B 12/70 | 102/334 |
| 4,932,328 | A * | 6/1990 | Pinkney | F42B 8/26 | 102/368 |
| 4,947,753 | A * | 8/1990 | Nixon, III | F42B 8/26 | 102/269 |
| 5,654,523 | A * | 8/1997 | Brunn | F42B 8/26 | 102/368 |

(Continued)

FOREIGN PATENT DOCUMENTS

| | | | | |
|---|---|---|---|---|
| GB | 191114682 A * | 4/1912 | | F42B 3/28 |
| GB | 1396655 A * | 6/1975 | | B32B 3/266 |

*Primary Examiner* — Jonathan C Weber

(57) ABSTRACT

In some examples, a charge holder for a grenade has an envelope made from one or more layers of a sheet material to define an interior volume to receive a charge having a charge volume less than or equal to the interior volume and a neck configured to connect to a flashbang grenade body, wherein a ratio of a charge volume of the interior volume to an envelope material volume is about 5.0 or greater.

17 Claims, 5 Drawing Sheets

(56) References Cited

U.S. PATENT DOCUMENTS

| | | | | |
|---|---|---|---|---|
| 5,824,945 | A * | 10/1998 | Barlog | F42B 8/26 102/482 |
| 7,412,929 | B2 * | 8/2008 | Walsh | F41H 9/10 102/355 |
| 8,161,883 | B1 | 4/2012 | Harasts | |
| 9,470,495 | B2 * | 10/2016 | Kravel | F42B 27/00 |
| 9,989,340 | B2 * | 6/2018 | Grassi | F42B 12/42 |
| 10,030,955 | B1 * | 7/2018 | Sapp | F42C 14/02 |
| 2006/0081147 | A1 * | 4/2006 | Walsh | F42B 27/00 102/368 |
| 2006/0096485 | A1 * | 5/2006 | Stark | F42B 5/181 102/202 |
| 2010/0224092 | A1 * | 9/2010 | Kapeles | F42C 19/02 102/368 |
| 2017/0102219 | A1 * | 4/2017 | Grassi | F42B 27/00 |

* cited by examiner

HIGH-FRAGMENTING FLASHBANG GRENADE CHARGE HOLDER

BACKGROUND

In the art of flashbang grenades, the cartridge consists of a charge holder that holds the pyrotechnic mixture. The requirement of the charge holder is that it should be both strong enough to assure the combustible mixture's integrity during handling and carrying of the grenade. In some applications, the charge holder should also be waterproof. The charge holder should be able to withstand drops, vibration, humidity, temperature and the like. The typical charge holder is made from either cardboard or plastic. Charge holders made from such materials can occasional create a performance issue during explosion of the flash bang grenade. During explosion, the charge holder fragments into large pieces. Since these fragments are not consumed by the pyrotechnic charge, depending on the size of the fragments, the fragments can block the grenade discharge vents. This negatively impacts the desired characteristics of a flashbang grenade, in light output, noise, and unwanted movement due to grenade ports being blocked. In the situation where a large charge holder fragment does not block the vent, it is discharged at high velocity from the flash bang grenade creating a potential hazard to the surroundings. The flash bang grenade is only designed to emit both loud noise and light, and not to emit high velocity projectiles with any harmful energy. It is an object of the invention to eliminate charge holder fragments from becoming high velocity projectiles during explosion of the flashbang grenade, but also not to block the grenade vent holes. One advantage of using cardboard and plastic is that these materials have low thermal conductivity. When fragments from these materials are expelled during explosion, it is very unlikely a fragment carries enough thermal energy to cause a fire to the surroundings. It is an object of this invention that any fragment being discharged from a flashbang grenade has low thermal energy.

A charge holder described in Harasts, U.S. Pat. No. 8,161,883, is multicomponent and is designed to be used in combination with a very specialized pyrotechnic formulation that consumes an inner sleeve of the charge holder. The charge holder itself is a three-piece charge holder with a portion thereof having a reaction-consumed, aluminum slip-fit sleeve fitted inside a thick and non-consumable and non-fragmenting aluminum charge holder. The aluminum sleeve is part of the pyrotechnic charge and is not the charge holder. It is important to note that the charge holder itself does not fragment as it has large vents. The sleeve is consumed in the explosion due to the particular explosive mixture used in this flash bang grenade clearing the way for the explosive mixture to leave the charge holder through the vent holes in the charge holder itself before the explosive mixture passes through the grenade vent holes. The vent holes in the charge holder's main body resolves the fragmentation issue by itself not holding back the charge, and thus the charge holder does not fragment nor does the portion of the sleeve supported by the charge holders main body (which shields the sleeve from high pressure). The charge holder of the '883 patent functions to filter large fragments. The arrangement if needing to be waterproofed further requires yet another external 'container' to waterproof the cartridge (charge holder and explosive mixture) that must also be consumed. In the same manner as the internal sleeve is supported by the main body of the charge holder, the external sleeve only sees 'vent windows' of pressure as well (outer sleeve is shielded from high differential explosive pressure as well as temperature). This significantly reduces the fragments of the external water proofing sleeve if they were not consumed. The disadvantages with this charge holder design, other than requiring a very special pyrotechnic formulation to consume the sleeve, requires a non-consumable charge holder main body having vent holes, and requires sealing to make waterproof which adds manufacturing complexity.

BRIEF DESCRIPTION

In some examples, a charge holder for a grenade has an envelope made from one or more layers of a sheet material to define an interior volume to receive a charge having a charge volume less than or equal to the interior volume and a neck configured to connect to a flashbang grenade body, wherein a ratio of a charge volume of the interior volume to an envelope material volume is about 5.0 or greater.

In some examples, a grenade comprises a grenade body, a charge holder comprising an envelope made from one or more layers of a sheet material to define an interior volume to receive a charge of a pyrotechnic material and further comprising a neck configured to connect to the grenade body and a charge of a pyrotechnic material having a charge volume less than or equal to the interior volume. A ratio of the charge volume to an envelope material volume is about 5.0 or greater.

BRIEF DESCRIPTION OF THE DRAWINGS

The invention may take physical form in many shapes, the embodiments of which will be described in detail in this specification and illustrated in the accompanying drawings which form a part hereof and wherein.

DETAILED DESCRIPTION

Figure 1:
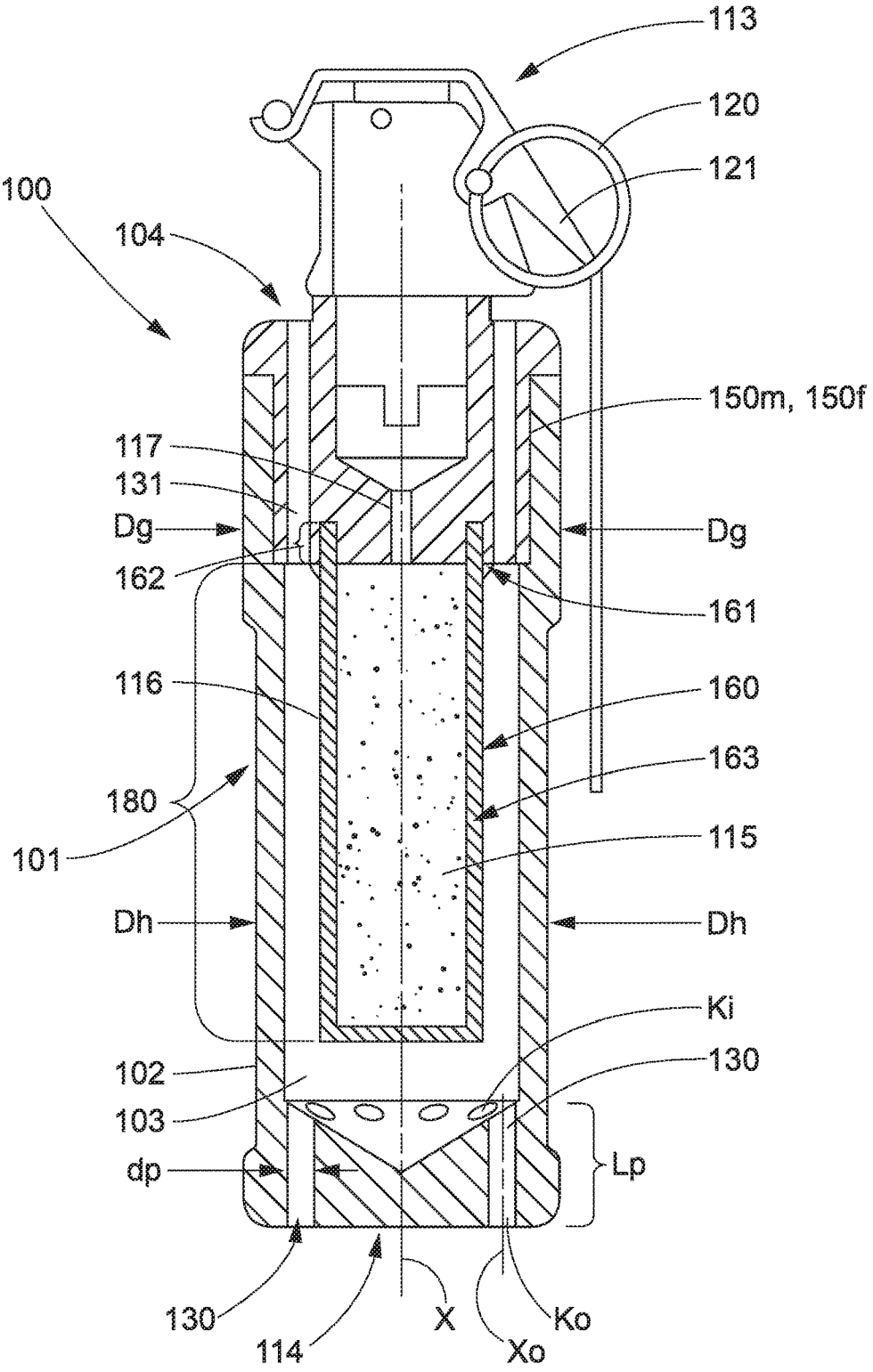
FIG. 1 is a cross sectional view of an associated stun grenade having a charge holder.

In accord with aspects of the present concepts disclosed herein, there is provided a charge holder construct that is waterproof, simple to manufacture, and does not need to be consumed by a special pyrotechnic formulation.

In order for flashbang grenades to be commercially viable, the charge holder needs to be simple and low cost. During manufacturing, the charge holder is first filled with an explosive mixture and then this assembly (the cartridge comprising the charge holder and the explosive mixture) is mounted to the grenade body. Mounting of the cartridge to the grenade body is typically performed by gluing, a tedious process in which the glue must bond to both the charge holder body (plastic or cardboard) and grenade body (metal) with the charge holder containing the explosive mixture. In some examples of the present concepts (see, e.g., FIG. 4) an improved charge holder design is provided that eliminates the need for gluing and instead provides for fastening of the charge holder to the associated grenade body without the need for gluing.

Disclosed herein are example charge holders that (1) are low cost, (2) are not consumed by the pyrotechnic formula when the flashbang grenade explodes, (3) do not cause any of the charge holder itself to act as a projectile, (4) do not increase the chances of a fire, (5) do not block the flashbang grenade vents so as to improve the grenade light and sound characteristics, (6) can be assembled using a fastener on the charge holder, and/or (7) is strong enough to undergo drop tests without breaking apart.

The above-noted objects and functions are met by the disclosed charge holder, the disclosed cartridge, and/or the disclosed grenade body incorporating such cartridge. In some examples, the charge holder comprises, or is formed from, a thin, flexible material (a sheet material) such as, but not limited to, a metal-plastic laminate, a "foil" (thin metal or alloy), or a non-metallic material (e.g., a fabric, etc.). In at least some aspects of the present concepts, the sheet material has a melting temperature lower than the explosion temperature within the grenade body, typically less than about 1300° F. In some examples, a sheet material comprising a metal foil, which may itself be a laminate or comprise other metals and/or other materials, having melting temperatures less than about 1300° F. includes tin, aluminum, magnesium, or metal alloys made from these metals. Foils are generally characterized by a high thermal conductivity and a low specific heat. Provided the foil is thin, the foil will heat up to a temperature where the material strength properties are very low, causing the foil to become extremely flexible. For this reason, aluminum foil is an extremely good candidate for use as a sheet material in the disclosed charge holder since it is both low in specific heat and has high thermal conductivity. Woven laminated fabrics, such as Tyvek® or polyester fabric, are also good material candidates for the sheet material. Sheet material, as used herein, may also include composite materials, such as a fabric comprising a woven metal.

As noted above, the example charge holder envelope comprises a sheet material. In some examples, a majority of the example charge holder envelope comprises a sheet material. In some examples, substantially all of the example charge holder envelope comprises a sheet material. In some examples, the portions of the charge holder envelope which are most prone to fragmentation (e.g., surface areas not constrained or supported by other parts of the grenade body, such as the neck area) comprise a sheet material that is extremely thin (e.g., less than about 0.020") and, at elevated temperature (e.g., temperatures that occur due to chemical reactions which exceed about 800° F.), is flexible (e.g., at least generally comparable to clothing fabrics or paper stock), foldable and/or pills (e.g., "pilling" is exemplified by synthetic thread that under a heat gun or a match flame will "ball"). As determined by the present inventor, the areas of the envelope which are most prone to fragmentation are the walls and therefore this area, in particular, are desirably thin to achieve the characteristics noted above. If the envelope shape is cylindrical, as is described below in some embodiments, the walls will have the highest stresses during detonation of the pyrotechnic charge.

To eliminate large charge holder fragments, without a special pyrotechnic formula that consumes the fragment material or a filter (e.g., a vent window as in '883), the disclosed charge holder utilizes sheet material configured to fragment, ball up (pill) and/or melt in a manner that grenade function is not unduly compromised. As determined by the present inventor, the charge holder heat up rate is directly proportional to an amount of envelope material and, correspondingly, the envelope thickness matters. A thin envelope formed from or comprising a thin sheet material allows the sheet material to heat up so rapidly that it substantially instantly melts or loses material strength properties and pills (balls up). In addition, the sheet material itself can be wrapped as a multilayer (e.g. multilayer cylindrical tube), thus optimizing higher surface area for heating when the charge holder envelope fragments. Thus, a multilayer envelope charge holder construct can be made by rolling or from using laminated sheet material. In this manner, the envelope itself can be made somewhat stronger while retaining a very fast heat up rate during the charge explosion and the holder's envelope fragmenting.

The present inventor has determined that the ratio of the charge volume (CV) of the charge holder (amount of pyrotechnic volume) to the amount of envelope material volume (MV) that makes up the charge holder can be used to characterize the charge holder performance. The CV/MV ratio of this disclosure is greater than a CV/MV of above about 5.0. In some examples, the CV/MV ratio of this disclosure is between about 5.0-7.5. In some examples, the CV/MV ratio of this disclosure is between about 7.5-15.0. In some examples, the CV/MV ratio of this disclosure is between about 15.0-30.0. In some examples, any of the aforementioned CV/MV ratios between 5.0-30.0 are combined with a requirement that the hoop stress of the envelope is equal to or in excess of 1000 psi. In contrast, the present inventor has determined that conventional plastic or cardboard charge holders have a CV/MV of about or less than 4. The presently preferred CV/MV ratio of charge holders disclosed herein is above 7.5. In some examples, the CV/MV ratio of charge holders disclosed herein is above between 7.5 to 15. In some examples, the CV/MV ratio of charge holders disclosed herein is above between 15-30.

In some examples, the preferred envelope shape is generally cylindrical and may take the form factor of, for example, a sock, a cylinder, or an elongated tube. As noted above, in some examples, the "hoop stress" of the generally cylindrical or cylindrical charge holder at room temperature is desirably greater than about 1000 psi, which allows the reaction pressure of the pyrotechnic charge to take place at higher than atmospheric pressure of about 14 psig.

In some examples, a sheet material (e.g., a metal foil, etc.) is sprayed with or coated with a glue or plastic to create a laminate sheet with a bonding strength great enough to allow a hoop stress exceeding 1000 psi. This laminated sheet material permits at least one end of the envelope (e.g., in the form of a cylinder) to be closed, and the cylinder wall to be edge bonded (e.g., the plastic can be melted together to act as a bonding agent and sealing the joint to make it waterproof). Different sheet materials can be also be used in combination.

As noted above, in some aspects of the present concepts, it is desired to eliminate a gluing operation during manufacture of the charge holder following filling of the charge holder with explosive material and during or following attaching of the charge holder to the grenade body. In some examples, the charge holder includes an end portion with a mechanical connector, such as a threaded portion (e.g., a neck with a threaded portion) or a male/female connector. In some examples, the mechanical connector (e.g., a threaded portion) is formed on or molded onto the example neck of the example charge holder. In some examples, the neck and mechanical connector are made from the same material. In some examples, the neck and the mechanical connector are made from different materials. For instance, the example charge holder envelope is made from a first material and the end cap having a mechanical connector can be a separate piece made from a second material. In another example, the example neck and mechanical connector are made from a plastic material bonded to the charge holder body (e.g., the charge holder body comprising an aluminum-plastic laminated foil). In some examples, a different material can be used for the mechanical connector and charge holder end cap since this portion of the charge holder does not fragment as much as the envelope walls during the charge explosion. Thus, the charge holder envelope during explosion can be made to break away from the endcap. A plastic end cap having a mechanical connector is advantageous as well since the lip of the threaded end cap is self-sealing due to the material being plastic and conformable. The plastic lip conforms to the metal grenade body where joined or fastened and forms a waterproof seal from biasing the lip against the metal grenade body. In some examples, where the mechanical connector includes threads and the threads provide a redundant waterproof seal. Accordingly, a charge holder bearing the mechanical connection can thus be used with an appropriate change to the grenade body to allow the charge holder, once filled with explosive mixture (the cartridge), to be mechanically connected into the grenade body without the need for a gluing operation. Alternatively, even if the mechanical connector is not configured to provide a waterproof seal, the mechanical connection of the charge holder to the grenade body eliminates the need for a clamping operation during the gluing operation.

In some examples, both sides of an envelope formed as a cylindrical shape may include a neck with a mechanical connector, such as a threaded neck. A two neck configuration permits one side of the envelope to be attached to a fuse side of the grenade body (top end wall in FIG. 1) and the opposite side (bottom end wall in FIG. 1) to support the charge holder "cylinder" portion for handling purposes so that thin walls need not have to support high impacts if the grenade is mishandled. Appropriate changes to the grenade body itself, such as a hole in the bottom end wall for one of the two necks may have to be made for this.

As described herein, during the explosion of the grenade, the charge holder envelope fragments as the sheet material used to form the charge holder envelope is quickly heated to at, or near, melting temperature due to a designed thinness of the wall thickness, resulting in the majority of the charge holder envelope fragments to pill (ball up) forming micro balls having little to no mass. If the micro balls are ejected from the grenade vent holes, they have very little momentum energy being that they are very small in volume. Also, since the micro balls are so small, they instantly cool with the surrounding entrained air. With enough metal foil laminations, the charge holder construct of this disclosure can at least be made to exceed a cardboard or plastic charge holder in strength. At the same time, since the charge holder disintegrates into very tiny parts, this prevents the grenade vents from being blocked. Another advantage of the example charge holder envelope is that it can be formed into shapes other than a cylinder such as, but not limited to, a spherical shape, an oblong shape, or a shape similar to that of a toothpaste container. Spherical shapes are advantageous since the surface area is minimized to the charge holder's volume, resulting in even fewer potential fragments while simultaneously increasing the charge holder envelope strength. However, an envelope in a spherical shape construct in accord with aspects of the present concepts is more expensive to manufacture and more cumbersome to handle than that of an envelope in a cylindrical form, toothpaste form, or even a tube having necks on both ends.

Yet another advantage of the example charge holder of the present disclosure is that the smaller the wall thickness, the smaller the fragments that lead to pilling that create micro balls. The charge holder in this disclosure, regardless of design, fragments upon explosion resulting in smaller sized pieces, thus lessening a chance of asymmetrically vented gases to cause the grenade to become a projectile. Another distinct advantage is the charge holder itself need not be consumed by the charge reaction, or that it requires any special pyrotechnic formulation. This is because the charge holder wall material can be heated quickly to a temperature where its material strength is significantly reduced, hence the reason for a higher CV/MV as compared to conventional grenades (it is to be noted, some of the energy from the pyrotechnic charge is used to heat up the charge holder). At elevated temperatures, metal loses at least 90% or more of the material strength properties. This permits the sheet material used for constructing the charge holder of this disclosure to use metal foil.

The pilling phenomenon described above can be easily demonstrated by performing a "heating up to melting effect," which can be observed by taking a standard propane torch and aiming at a sheet of household aluminum foil or Tyvek material or the like. The sheet or foil instantly either melts or crumples from a loss of material properties, but it also instantly cools due to the high surface to volume ratio. In comparison, neither plastic nor cardboard will be observed to do this. One can also see that after the maximum tensile stress of the material is exceeded, the foil/fabric is much more likely to break up into very small pieces. In addition, in a worst case event (a lower than desired level of pyrotechnic charge fill), even if the foil does not pill into a micro ball during the explosion, the foil/fabric at high temperature has little material strength and the hot explosive gases (even with an under charge) will easily push the charge holder fragments through a grenade vent preventing vent blockage (like any fabric). Thus, a piece of sheet can be made to easily pass through any grenade vent in contrast to either cardboard, plastic, or a thick piece of aluminum foil that does not heat up to the melting temperature, or has a loss of material strength as described.

Further, if a piece of fabric or foil passes through a grenade body vent, the thermal energy and the momentum are so negligible that the particle cools as rapidly as it is heated while passing through the air. Thus, the particle is not able to start a fire (not enough thermal energy) nor does it have enough mass as a projectile that it can travel very far or with any harm.

As noted above, an example charge holder in accord with aspects of the present concepts can be formed in the shape of a toothpaste tube, where the bottom of one side is made to be flattened and rolled over (crimped/bonded etc.) while the opposite end comprising a mechanical connector (e.g., a threaded end piece) that can be connected to (e.g., threaded into) a corresponding connector (e.g., a mating receiving end) of the grenade body, or glued. The sheet material type construct of this charge holder offers many advantages to the overall holder shape geometry as well as allowing up to one or more rolls to create the body itself. The sheet material (e.g., foil, etc.) type construction allows shapes that are not as easily fabricated in either plastic or cardboard material. If the sheet material comprises a laminated foil, different areas of the charge body may comprise different wall thicknesses, notably in the area of a threaded portion (for example a neck) that can be used to attach the charge holder to the grenade body. In some examples, the charge holder sheet material starts as a slug which formed into a sheet via a conventional forming method (e.g., extrusion, drawing, pressing, etc.), following which one or more coatings may be applied by a conventional application method such as spraying, dipping or the like. The charge holder of this embodiment may be advantageously be used in any flash-bang grenade that currently employs a standard cardboard or plastic charge holder to thereby offer a higher level of safety and potentially increase the manufacturability aspects of same. Stated differently, the example charge holders disclosed herein can be produced as a standalone product that can be used in combination with conventional flashbang grenade designs.

Referring now to FIG. 1, an example stun grenade 100 is shown according to U.S. Pat. No. 9,989,340 to Grassi et al., which is incorporated herein by reference in its entirety. It is to be emphasized that the example charge holders disclosed herein are not limited to the example stun grenade 100 depicted in FIG. 1 and can be used as a replacement to charge holders in use in other stun grenade designs, including those commonly found in the market today. In the example of FIG. 1, an example stun grenade 100 has an example housing 101 generally symmetric about a longitudinal axis X. The example grenade housing 101 is generally cylindrical and includes an example side wall 102, which can have more than one diameter (ID and/or OD) and/or vary in thickness. As shown in FIG. 1, the example housing 101 has two diameters Dg and Dh, where the respective diameters include a larger diameter for the ends of the grenade housing and a smaller diameter between the ends for a hand hold to enhance grip and to minimize a potential of slippage during use. Defined in the example housing 101 is an example cylindrical cavity 103 that is capped at the ends by a top end wall or end cap 104 and bottom end wall 114. In some examples, the top end wall or end cap 104 is fastened to the example side wall 102 by example threads **150*f* and 150*m*, where 150*f* is a female thread and 150*m*** is a male thread.

The example cylindrical cavity 103, although not shown as being sealed in FIG. 1, contains an example cartridge 116 including an example explosive charge 115 being held by an example charge holder 160 (a cartridge is the combination of a charge holder and a pyrotechnic charge). In the illustrated example, the explosive charge 115 is detonated by a fuse (not shown for simplicity) when the example safety pin 120 is pulled and an example lever 121 is also pulled, which ignites a flash charge (not shown, but which resides above a flash hole 117), which may occur after a preset delay. The flash charge, in turn, ignites the fuse, with the path of ignition of the fuse traveling through the example flash hole 117 and down into the example explosive charge, wherein it ignites the explosive charge 115. When the explosive charge 115 detonates, the products of combustion and fragments from the charge holder 160 are expelled through both example bottom orifice ports or vents 130 and example top orifice ports or vents 131. In some examples, the example bottom orifice ports or vents 130 and example top orifice ports or vents 131 can each have a longitudinal axis Xo such that the several axes are oriented parallel to the housing axis X.

Example ports 130, 131 shown in FIG. 1 are where the products of combustion are expelled to atmosphere. In the example of FIG. 1, the example orifice ports 131 and 130 are not equal in diameter or in length. In some examples, the example orifice ports 131 and 130 differ in diameter and/or length and/or shape. In some examples, the example orifice ports 131 and 130 are positioned to discharge at positions other than the top end wall 104 and the bottom end wall 114. In general, it is desirable to position and dimension the example orifice ports 131 and 130 so that the momentum transfer of the explosive charge is balanced in a manner to avoid force imbalances that would unduly accelerate the grenade 100 (e.g., so that the grenade does not act as a projectile itself from the detonation). In this regard, the products of combustion and the charge holder fragments are discharged along the longitudinal axis X of the device 100, and the momentum transfer is controlled by a number of factors including, but not limited to, the entrance coefficient of orifice ports (Ki), the diameter of the ports (dp), the length of the ports (Lp), and exit coefficient of the orifice ports (Ko). If a large fragment from the charge holder 160 were permitted to cause a blockage of one or more the associated grenade 100 ports, such blockage could affect or adversely impact the performance of the grenade 100, such as its output sound pressure level (dB) or luminosity, and/or disadvantageously cause physical movement of the grenade 100 during discharge.

While FIG. 1 shows the example charge holder element 160, the example wall thickness is shown to be fairly thick as it represents an example wherein the example charge holder element 160 is made from cardboard and/or plastic. As shown, the example charge holder 160 comprises an example neck 162 for connection to the example grenade 100 and an example envelope 180 for containment of an associated volume of an example pyrotechnic charge 115. In some examples, the example envelope 180 is made from one or more layers of an example sheet material 163. In some examples, this example sheet material 163 comprises a fabric or woven material, such as Tyvek® or high-density polyethylene fiber weave, a film (e.g., a polypropylene film) or a foil. As used herein, the term "sheet material" expressly includes flexible multi-ply materials (e.g., a sheet material having more than one layer of the same material, such as two layers of the same material oriented along different directions, and/or different materials) and flexible composite materials (e.g., a fiber-reinforced sheet material).

In the example of FIG. 1, an example adhesive line 161 (e.g., glue, epoxy, etc.) is depicted and represents one possible example of attachment, such as via a manufacturing process, between the example neck 162 of the example charge holder 160 and the example grenade 100 (e.g., the example end cap 104, etc.). As previously stated, the example charge holder 160 can be utilized in combination with conventional grenades.

Figure 2:
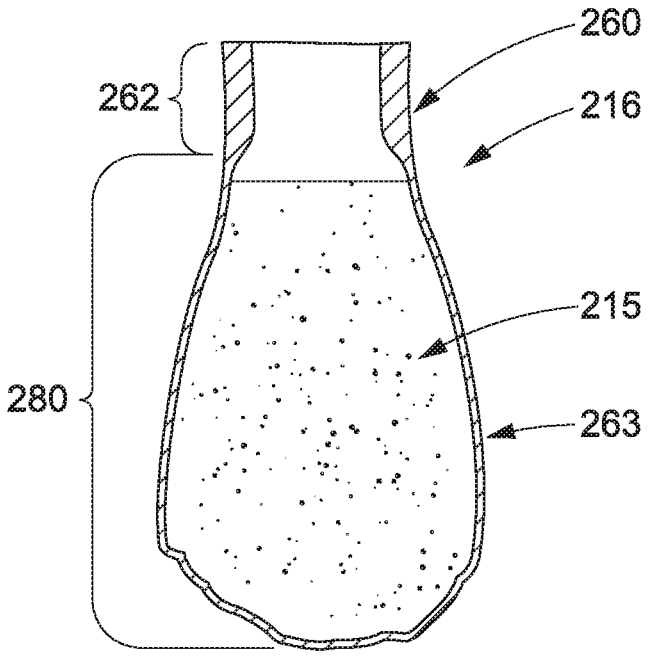
FIG. 2 is a cross-sectional view of one shape of a charge holder of the present disclosure.

FIG. 2 shows a cross-sectional view of an example charge holder 260 filled with an example pyrotechnic charge 215 prior to the cartridge 216 (i.e., the combination of the example charge holder 260 and the example pyrotechnic charge 215) being attached (e.g., via an adhesive, etc.) to a grenade body (not shown) at an example neck 262 of the example charge holder 260. As shown in FIG. 2, the example charge holder 260 has an example envelope 280 in the form of a "sock," whereas FIG. 1 shows the example envelope 180 in the shape of a "cylinder.". In the example of FIG. 2, the example envelope 280 is formed from a sheet material 263. In some examples, the example sheet material 263 of the example charge holder 260 of FIG. 2, or of other charge holders disclosed herein, can be a fabric or woven material, such as Tyvek® or a high-density polyethylene fiber weave, a film (e.g., a polypropylene film, etc.) or a foil.

Figure 3:
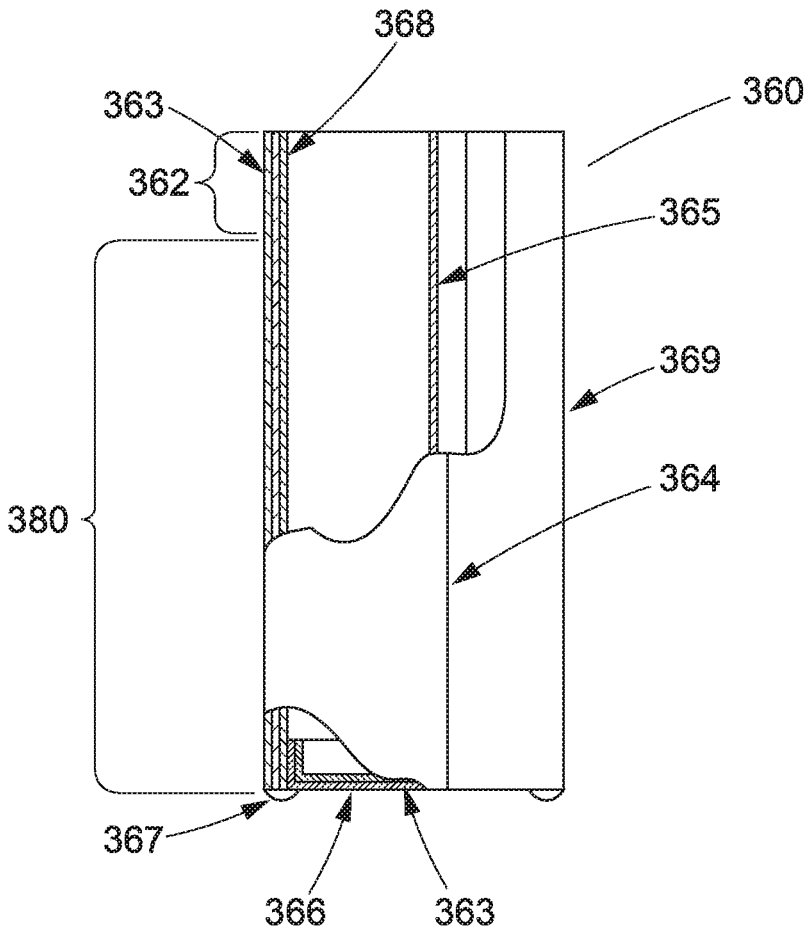
FIG. 3 is a broken side sectional view of second embodiment of a charge holder of the present disclosure.

FIG. 3 shows a sectional cut-away view of a portion of an example charge holder 360 having an example neck 362 and an example envelope 380. In some examples, the example envelope 380 is formed from an example sheet material 363 (e.g., a foil, a fabric, a woven material, etc.) forming, or facilitating the formation of, a closed form factor. For instance, in the example of FIG. 3, the example sheet material 363 is wrapped around three times to form an example cylinder 369. In some examples, an example distal end 364 of the example sheet material 363 (e.g., a cylinder edge) is secured to an underlying layer of the example sheet material 363 via an adhesive (e.g., an integrated adhesive strip 365, an applied adhesive material, etc.). In some examples, the connection between the example distal end 364 and the underlying example sheet material 363 forms a waterproof seal. The example of FIG. 3 also shows an example bottom lid 366 sealing a bottom portion of the example envelope 380. In some examples, the example bottom lid 366 is made from a sheet material 363 (e.g., foil, etc.). In some examples, the example bottom lid 366 is mechanically and/or adhesively connected to the example envelope 380. For instance, an example bottom lid comprising a sheet material 363 may be pressed into or wrapped around a bottom portion of the example envelope, at an inner diameter or at an outer diameter, to form a bottom end to the example cylinder 369, thus forming the example envelope 380 into a closed cylinder form factor. In the example shown in FIG. 3, the example bottom lid 366 is shown to be sealed by an adhesive 367. Alternatively, the same example envelope 380 shape can be made by layering a sheet material 363 (e.g., foil, etc.), and then pressing and forming. As noted above, the sheet material 363 may include a plurality of layers of material that may include one material or a plurality of different materials and may include, for example, of sheets of such sheet material 363 (a layering of sheet materials 363). In some examples, the sheet material 363 comprises laminated aluminum foil. In any of the aforementioned methods of construction of the example charge holder 360, the resulting charge holder 360 must be able to withstand a pressure build up sufficient to enable the pyrotechnic charge reaction to take place at an elevated pressure of about or greater than 14 psig relative to atmospheric pressure. As previously described, the hoop stress (or otherwise wall stress in tension) is advantageously configured to withstand stresses greater than 1000 psi.

As shown, the example sheet material 363 can incorporate plastic adhesive layer (laminate) 368 and adhesion can be accomplished with using an oven or hot gun to eliminate a strip of adhesive 365. Other laminated coating material other than plastic is also possible. For instance, a laminated coating material may include a paraffin wax (e.g., for waterproofing). In some examples, the example plastic adhesive layer 368 is equal to or less than 40 microns. In some examples, the plastic adhesive layer 368 comprises hydrocarbons that vaporize during the explosion.

Figure 4:
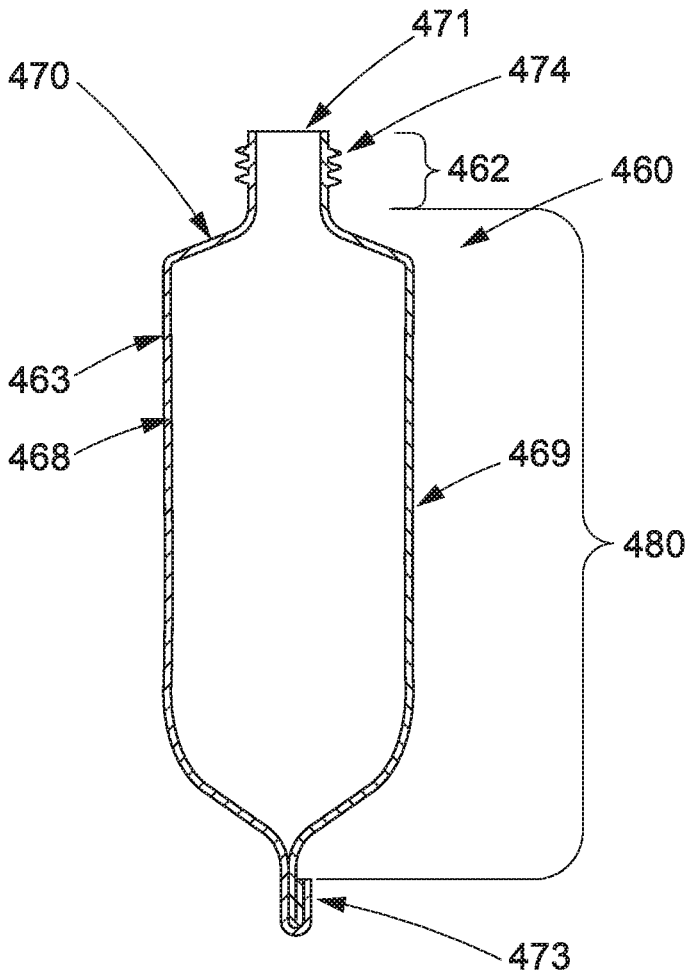
FIG. 4 is cross-sectional view of a third embodiment of a charge holder of the present disclosure.

FIG. 4 shows a side view of an example charge holder 460 having an example envelope 480 in the form of a example cylinder 469, like that in FIG. 3, but also having an example top end cap 470 and an example bottom seal 473 similar to that seen in "toothpaste" type containers. The example top end cap 470 can either be formed from the sheet material 463 (e.g., foil, etc.) of the example cylinder 469, or can be independently first made and then glued or adhered to the example cylinder 469. In some examples, an injection type molded plastic top end cap 470 is adhered to the example cylinder 469 by melting into a sheet material 463 made from a foil-plastic laminate 468. The example top end cap 470 is thus able to be easily manufactured from plastic. An example lip 471 and/or example mechanical connector 474 (e.g., threads) in the area of the example neck 462 can be used to seal the example charge holder 460 to an associated grenade body (not shown). In some examples, the example bottom seal 473 of the example charge holder 460 comprises a neck with a sealed end. Although not shown, the bottom of the example cylinder 469 can alternatively be sealed in the same manner as was shown and described in FIG. 3 using an example bottom lid 366.

Figure 5:
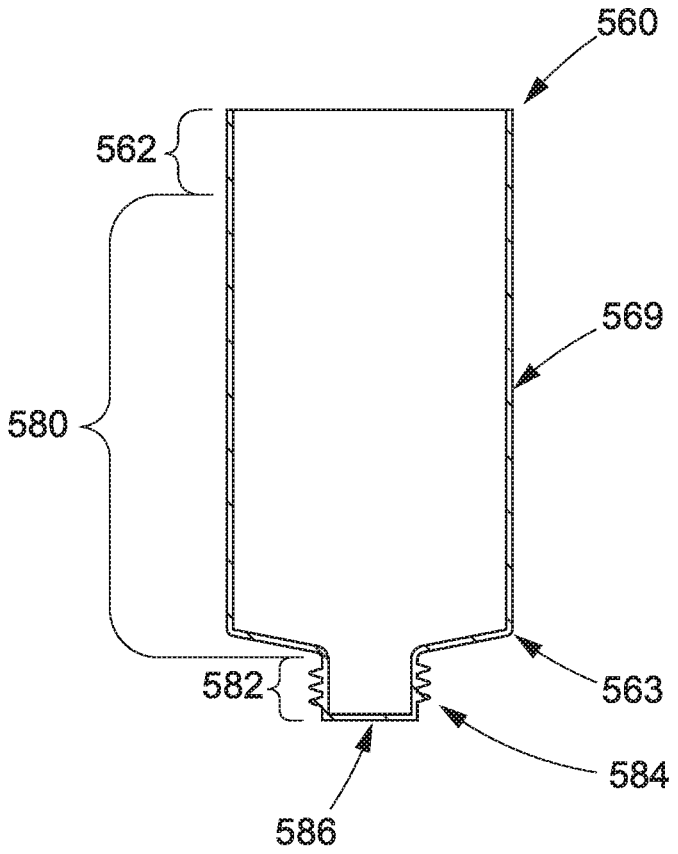
FIG. 5 is a cross-sectional view of a fourth embodiment of a charge holder of the present disclosure.

FIG. 5 shows another example charger holder 560 in sectional view. The example neck 562 is for filling with charge and then gluing to an associated grenade. The example neck 562 shares envelope's 580 wall of charge holder cylinder 569. The example sheet material 563 is shown as one layer. In other examples, the example sheet material 563 comprises a plurality of layers. FIG. 5 shows an example charge holder 560 comprising an example bottom neck 582 including example bottom threads 584. The example neck 562 includes an example bottom lid 586. FIG. 5 illustrates an example in which a bottom of the charge holder 560 is supported. Although not shown, the example neck 582 and example threads 584 can be used to support the charge holder 560 (or other embodiments shown in this disclosure) if fitted or attached to a receiver of an associated grenade. Thus, the example neck 582 can be configured to fit into an associated grenade body to help support the charge holder 560 during a drop test given that the envelope 580 (charge holder 560) is weak. This area is very unlikely to fragment, and could potentially block gas ports; however, being on the bottom, this can be easily diverted during explosion of the charge so as to not block grenade ports (see FIG. 1 at the bottom near 114 the conical area can be further recessed).

The embodiments as described and shown in FIGS. 2-5 can be used to improve the performance of a flashbang grenade (e.g., the grenade in FIG. 1). The improvement in performance results from vent holes that are not blocked by a charge holder fragment as described herein. A further advantage is that expelled fragments of this charge holder do not carry enough energy to cause any damage to the surroundings from either momentum energy or from thermal energy. The use of example charge holders 160 through 560, as described herein, improves the safety of flash bang grenades as well as the performance.

A number of exemplary embodiments have been described herein. Obviously, modifications and alterations will occur to others upon reading and understanding the preceding detailed description. For instance, whereas examples herein describe an example charge holder comprising an envelope made from one or more layers of a sheet material to define an interior volume and an example neck comprising a connector (e.g., a threaded portion, a surface to receive an adhesive, a male connector, a female connector, etc.) to connect the envelope to a flashbang grenade body, another example charge holder in accord with aspects of the present concepts includes an envelope made from one or more layers of a sheet material to define an interior volume and an example recess (e.g., a female portion, an inverted neck, etc.) comprising a connector (e.g., a threaded portion, a surface to receive an adhesive, a male connector, a female connector, etc.) to connect the envelope to a flashbang grenade body. It is intended that the present disclosure be construed as including all such modifications and alterations insofar as they come within the scope of the appended claims or equivalents thereof.

What is claimed is:

1. A charge holder comprising:

an envelope made from one or more layers of a laminated sheet material to define an interior volume to receive a charge having a charge volume less than or equal to the interior volume; and a neck configured to connect to a flashbang grenade body;

wherein a ratio of a charge volume to an envelope material volume is 5.0 or greater, wherein the one or more layers of the laminated sheet material have a total thickness of between 0.0005 to 0.02 inches, and wherein the envelope is configured to withstand a hoop stress level of greater than 1000 psi without failure.

2. The charge holder of claim 1, wherein the envelope is in the form of a sock, a toothpaste container, or a sphere.

3. The charge holder of claim 1, wherein the envelope is generally cylindrical in shape.

4. The charge holder of claim 1, wherein the one or more layers of the laminated sheet material comprises a metal foil, a metal alloy foil, a laminated coating of a plastic type material, a laminated coating of an adhesive material, or a laminated coating of a plastic type material and a laminated coating of an adhesive material.

5. The charge holder of claim 1, further comprising:

a charge of a pyrotechnic material having a charge volume more than 5.0 times the envelope material volume.

6. The charge holder of claim 1, wherein the one or more layers of the laminated sheet material comprises tin, aluminum, or magnesium.

7. The charge holder of claim 1, wherein the envelope comprises a pilling material comprising at least one of a water repellant fabric, a woven laminated fabric, or a polyester fabric, or any combination thereof.

8. The charge holder of claim 1, wherein the neck includes a first threaded connector configured to matingly engage a corresponding second threaded connector of a body of the flashbang grenade body.

9. The charge holder of claim 1, wherein the one or more layers of the laminated sheet material have a total thickness of between 0.002 and 0.02 inches.

10. The charge holder of claim 1, wherein the ratio of the charge volume of the interior volume to the envelope material volume is between 7.5-300.

11. The charge holder of claim 1, wherein the ratio of the charge volume of the interior volume to the envelope material volume is between 5.0-7.5, between 7.5-15.0, between 15.0-300.0, or between 5.0-3000.0.

12. A flashbang grenade comprising:

a flashbang grenade body;

a charge holder comprising an envelope made from one or more layers of a laminated sheet material to define an interior volume to receive a charge of a pyrotechnic material and further comprising a neck configured to connect to the flashbang grenade body; and a charge of a pyrotechnic material having a charge volume less than or equal to the interior volume, wherein a ratio of the charge volume to an envelope material volume is 5.0 or greater, wherein the one or more layers of the laminated sheet material have a total thickness of between 0.0005 to 0.02 inches, and wherein the envelope is configured to withstand a hoop stress level of greater than 1000 psi without failure.

13. The flashbang grenade of claim 12, wherein the envelope defines a charge volume to envelope material volume ratio of between 7.5-300.

14. The flashbang grenade of claim 13, wherein the envelope is configured to withstand said hoop stress without failure at a temperature less than 1300° F.

15. The flashbang grenade of claim 12, wherein the envelope is generally cylinder in shape.

16. The flashbang grenade of claim 12, wherein the one or more layers of the laminated sheet material comprises a metal foil, a metal alloy foil, tin, aluminum, magnesium, a water repellant fabric, a polyester, a woven laminated fabric, or a polyester fabric.

17. The flashbang grenade of claim 12, wherein the charge holder comprises wherein the neck includes a first threaded connector configured to matingly engage a corresponding second threaded connector of the flashbang grenade body.

* * * * *